US005839667A

United States Patent [19]

Fishcer

[11] Patent Number: 5,839,667

[45] Date of Patent: Nov. 24, 1998

[54] PENDENT-TYPE DIFFUSER IMPINGEMENT WATER MIST NOZZLE

[75] Inventor: Michael A. Fishcer, West Kingston, R.I.

[73] Assignee: Grinnell Corporation, Cranston, R.I.

[21] Appl. No.: 815,839

[22] Filed: Mar. 12, 1997

[51] Int. Cl.[6] ..... B05B 1/26

[52] U.S. Cl. ..... 239/498; 239/504; 169/37

[58] Field of Search ..... 239/498, 504, 239/518, 521, 522; 169/37

[56] References Cited

U.S. PATENT DOCUMENTS

| | | | |
|---|---|---|---|
| 316,581 | 4/1885 | Stratton | 169/37 |
| 400,688 | 4/1889 | Kersteter . | |
| 447,004 | 2/1891 | Nagle . | |
| 450,574 | 4/1891 | Byers . | |
| 733,646 | 7/1903 | Hibbard . | |
| 776,614 | 12/1904 | Phelps . | |
| 1,498,139 | 6/1924 | Williams . | |
| 2,076,483 | 4/1937 | Rowley | 239/498 |
| 2,135,138 | 11/1938 | Kendall | 239/500 |
| 2,310,798 | 2/1943 | Lewis | 239/544 |
| 2,361,144 | 10/1944 | Loepsinger | 239/424 |
| 2,493,982 | 1/1950 | Lee | 239/544 |
| 2,495,208 | 1/1950 | Causer | 169/37 |
| 3,561,537 | 2/1971 | Bix | 169/38 |
| 3,682,251 | 8/1972 | Livingston | 169/37 |
| 4,580,729 | 4/1986 | Pounder | 239/524 |
| 4,989,675 | 2/1991 | Papavergos | 169/14 |
| 5,014,790 | 5/1991 | Papavergos | 169/44 |
| 5,152,344 | 10/1992 | Fischer et al. | 169/37 |
| 5,366,022 | 11/1994 | Meyer et al. | 169/37 |
| 5,392,993 | 2/1995 | Fischer | 239/522 |
| 5,505,383 | 4/1996 | Fischer | 239/518 |
| 5,513,708 | 5/1996 | Sundholm | 169/37 |

FOREIGN PATENT DOCUMENTS

| | | | |
|---|---|---|---|
| 146803 | of 0000 | United Kingdom | 239/498 |
| 93/00962 | 1/1993 | WIPO . | |

*Primary Examiner*—Lesley D. Morris
*Attorney, Agent, or Firm*—Fish & Richardson P.C.

[57] ABSTRACT

A pendent-type diffuser impingement water mist fire protection nozzle has a body defining an orifice and an outlet for flow of water from a source. The orifice defines an axis, and the outlet is disposed generally coaxial with the orifice. A diffuser is disposed generally coaxial with the axis of the orifice and defines a diffuser inner surface positioned for impingement of the flow of water thereupon and an opposite outer surface. The diffuser has a plurality of tines distributed about a diffuser periphery and defining a plurality of openings therebetween. The diffuser inner surface defines at least one channel extending along the inner surface of the diffuser toward a predetermined region of the diffuser periphery, preferably positioned to collect water impinging thereupon and to divert collected water toward the predetermined region of the diffuser periphery.

19 Claims, 4 Drawing Sheets

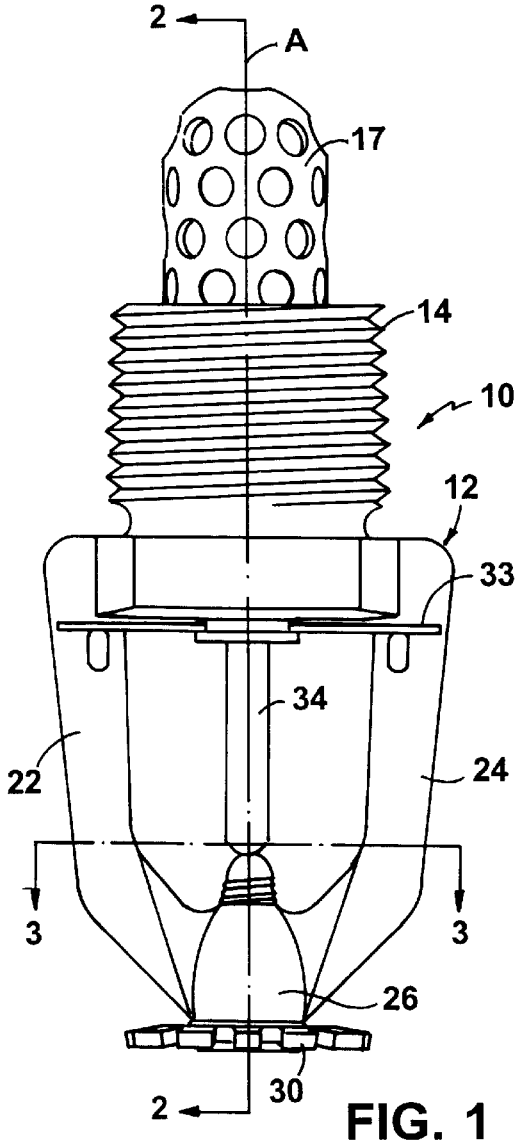
FIG. 1
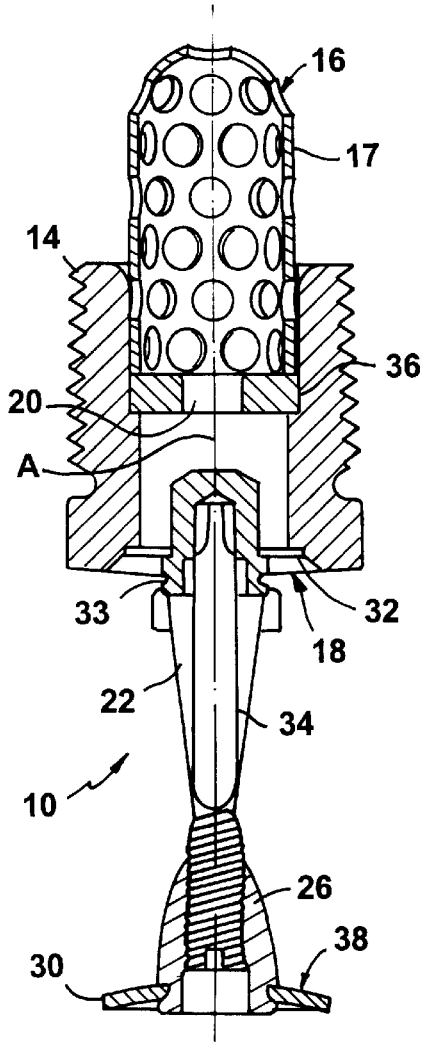
FIG. 2
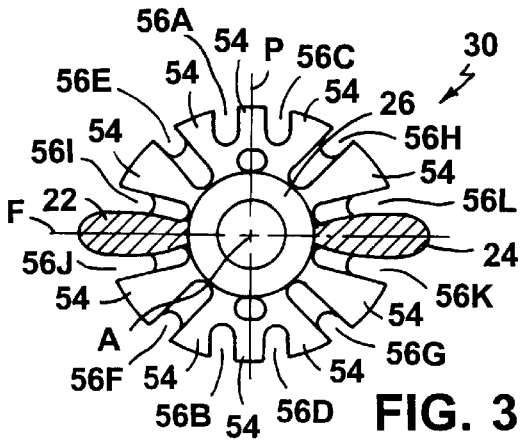
FIG. 3
FIG. 4
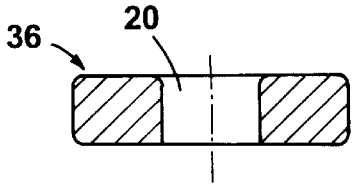

PENDENT-TYPE DIFFUSER IMPINGEMENT WATER MIST NOZZLE

This invention relates to water mist nozzles and sprinklers for fire protection service.

BACKGROUND OF THE INVENTION

Water mist fire protection systems are typically classified by one of several different criteria. These criteria include: (1) the method by which mist is generated; (2) the mode of nozzle operation, e.g. individual automatic, object protection (local application) array system, or total compartment deluge array system; and (3) the range of operating pressures. Water mist fire protection systems can also be subclassified by: water supply, e.g. separate or self-contained; nozzle operation, e.g. continuous or intermittent; water supply temperature (measured at the nozzle); and use of an additive. (Note: In this disclosure, the term "water" refers interchangeably to natural water and natural sea water as well as to appropriate mixtures of natural water or natural sea water with one or more additives for enhancement of fire fighting properties of a water mist fire protection system.)

The main types of water mist nozzles for fire protection include: diffuser impingement, pressure jet, gas-atomizing, and jet interaction.

Diffuser impingement nozzles operate by impacting a medium velocity, relatively coherent water jet against a diffuser. The diffuser breaks the stream into a high momentum mist with the widest range of droplet sizes (compared to other types of water mist nozzles), e.g. typically, 90% of the droplets are smaller than 600 microns. Impingement nozzles presently on the market operate over a range of pressure from about 7 bar (100 psi) to 17.2 bar (250 psi). For fire protection service, impingement nozzles can be individually automatically operating, e.g. for Class A ordinary combustible applications, or they can be used as open nozzles in an object protection system or a total compartment deluge system, e,g, for Class B flammable liquid hazard applications. Under certain conditions, individually operating diffuser impingement nozzles may be used for object protection systems where the primary hazard is Class B. In prior art applications, variations of impingement water mist nozzles have included use of multi-tined, spherical, or spiral-type diffuser, and also use of super-heated water in combination with a dispersion chamber internal to the nozzle. An automatically operating water mist nozzle of the multi-tined diffuser impingement type, for fire protection service, is described in Fischer U.S. Pat. No. 5,392,993. An open water mist nozzle of the spherical diffuser impingement type is described in Fischer U.S. Pat. No. 5,505,383.

Pressure jet water mist nozzles function by discharging high velocity streams of water through a number of relatively small orifices, typically employing a swirl action device within the chamber leading to the orifices, to assist in break-up of the water streams. A wide selection of pressure jet nozzle designs is available, operating over a range of pressure from about 5 bar (70 psi) to 280 bar (4060 psi). Pressure jet nozzles can also be individually activating or open. The open nozzles are employed as part of a local application or in a total compartment deluge system, and they have been combined with super-heated water to facilitate vaporization of the spray. Typically, 90% of the droplets of a pressure jet nozzle are smaller than 150 microns, at least for those operating at the high end of the pressure range. An automatic pressure jet nozzle for fire protection service is described in Sundholm U.S. Pat. No. 5,513,708. A pressure jet nozzle of the open type is illustrated in Sundholm International Patent Application WO 93/00962 (dated Jul. 20, 1993).

Gas-atomizing water mist nozzles (also referred to as twin-fluid nozzles) generate water mist by combining compressed gas with water in a mixing chamber located just upstream of the discharge orifices. Gas-atomizing nozzles utilize water pressure of about 5 bar (75 psi), and 90% of the droplets generated are typically smaller than about 250 microns. Gas-atomizing nozzles are typically limited to use in local application or total compartment deluge systems, since open nozzles are required to assure that the piping network provides the required combination of gas pressure and water pressure within the nozzles. Gas-atomizing water mist nozzles for fire protection purposes are illustrated in: Loepsinger U.S. Pat. No. 2,361,144 as well as Papavergos U.S. Pat. No. 4,989,675 and U.S. Pat. No. 5,014,790.

In jet interaction type water mist nozzles, multiple pairs of fine fluid jets strike each other at acute angles to break-up the water streams. Jet interaction nozzles typically operate over a range of pressure from 3 bar (45 psi) to 7 bar (100 psi), and their use is generally limited to manual hose nozzles for the extinguishment of low volatility flammable liquid fires by cooling and dilution, since the spray has relatively low momentum. Jet interaction water mist nozzles for fire protection service are illustrated in Lewis U.S. Pat. No. 2,310,798 and Lee U.S. Pat. No. 2,493,982.

SUMMARY OF THE INVENTION

According to the invention, a pendent-type diffuser impingement water mist fire protection nozzle comprises a body defining an orifice and an outlet for flow of water from a source, the orifice defining an axis and the outlet being disposed generally coaxial with the orifice, and a diffuser disposed generally coaxial with the axis of the orifice and defining a diffuser inner surface positioned for impingement of the flow of water thereupon and an opposite outer surface. The diffuser comprises a plurality of tines extending about a diffuser periphery and defining a plurality of openings therebetween, and the diffuser inner surface defines at least one channel positioned to collect at least a portion of the water impinging thereupon and to divert collected water toward a predetermined region of the diffuser periphery.

Preferred embodiments of the invention may include one or more the following additional features. The diffuser inner surface defines at least two, four or eight channels. The diffuser inner surface defines one or more through holes spaced from the diffuser periphery. At least one channel terminates at one end at an opening between the tines. The diffuser has an elliptical shape. At least one channel extends non-radially along the diffuser inner surface. At least one channel extends radially along the diffuser inner surface. The diffuser inner surface slopes away from the outlet outwardly from the axis. At least one channel has a depth in the range of about 0.015 inch to about 0.050 inch, preferably in the range of about 0.020 inch to about 0.040 inch, and more preferably about 0.025 inch. At least one channel has a width in the range of about 0.030 inch to about 0.090 inch, preferably in the range of about 0.045 inch to about 0.075 inch, and more preferably about 0.062 inch. The nozzle has a K-factor in the range of about 0.10 to about 1.0, or in the range of about 0.15 to about 0.70, or in the range of about 0.50 to about 0.70.

The invention concerns a pendent-type, diffuser impingement water mist nozzle, or fire protection sprinkler, having a body defining an inlet for connection to a source of water under pressure, an outlet, an orifice normally located just upstream of the outlet, and a substantially horizontal water distribution diffuser positioned downstream of, and opposing, the outlet. In diffuser impingement nozzles and sprinklers of the invention, the outlet may be normally closed by a plug held in place by a thermally responsive element configured to automatically release the plug when a sufficiently elevated temperature is sensed. Upon operation, the water mist nozzles and sprinklers of the invention, whether individually automatically operated or used open as part of a local application or total flooding system, a vertically directed, relatively coherent, single stream of water (downward for pendent nozzles and upward for upright nozzles) rushes through the outlet, from the orifice, towards the diffuser. As it impacts upon the inner surface of the diffuser, the water is diverted generally radially downward and outward, breaking up into a spray pattern, with channels defined by the diffuser inner surface positioned to collect at least a portion of the water impinging thereupon and to divert collected water towards predetermined regions of the diffuser periphery, the composite configuration of the resulting spray pattern being, in large part, a function of the diffuser design, and the spray pattern is projected over the intended area of coverage, i.e., the protected area.

In April, 1992, the International Maritime Organization (IMO) amended the regulations in Chapter II-2 of their SAFETY OF LIFE AT SEA (SOLAS) requirements to specify that all ships carrying more than 36 passengers in international transport and entering service after Oct. 1, 1994, be required to be protected in all applicable areas by either an automatic sprinkler system or its equivalent. Ships constructed prior to the 1974 edition of will be required to be retrofitted by 1997, and ships SOLAS constructed in accordance with the 1974 edition of SOLAS must be retrofitted by 2005, or within 15 years of construction, whichever comes later.

Water mist nozzles of the present invention are bound to meet the SOLAS requirements for an automatic sprinkler system equivalent, as established at the 40th Session of the IMO Sub-Committee on Fire Protection in July, 1995. The evaluation standards established by the IMO Sub-Committee on Fire Protection for determining whether an equivalent system, e.g. using water mist nozzles, will perform acceptably under fire conditions are contained in "Fire Test Procedures For Equivalent Sprinkler Systems in Accommodation, Public Space and Service Areas on Passenger Ships" and "Component Manufacturing Standards for Water Mist Nozzles" which were adopted by the IMO Assembly on Dec. 14, 1995 [Resolution A.800(19)].

These IMO fire test procedures comprise various fire tests corresponding to different SOLAS occupancy classifications. For example, the so-called "luxury cabin" fire test series correlates to fire protection of accommodation spaces of minor and moderate fire risk, as well as sanitary and similar spaces up to 50 $m^2$ (538 $ft^2$) in area. A further example is the so-called "public spaces" fire test series which correlates to fire protection of control stations, accommodation spaces of minor, moderate and greater fire risk, and sanitary and similar spaces over 50 $m^2$ (538 $ft^2$) in area. Another example is the so-called "shopping and storage" space series of fire tests which correlate to the fire protection of store-rooms, workshops, pantry type areas, laundry rooms and shopping areas, as well as other spaces in which flammable liquids (other than fuels) are stored.

The 2.5 m (8.2 ft.) high ceiling fire tests used to confirm the acceptability of water mist nozzles for fire protection service in the shopping and storage space category involve a fire source consisting of two central, 1.5 m (4.9 ft.) high, solid piled stacks of cardboard boxes packed with polystyrene plastic cups with unexpanded a 0.3 m (1.0 ft.) wide gap between them. The ignition of the fire source is at two floor-level points, at the base of the cartons, at both sides of the gap. The two ignition points are ignited in quick succession, and the gap between the cartons forms a flue space for the developing fire. Each stack is approximately 1.6 m (5.2 ft.) long and 1.15 m (3.8 ft.) wide. The fire source is surrounded by six 1.5 m (4.9 ft.) high solid piled stacks of empty cardboard boxes forming a target array to determine if the fire will jump the intervening aisles. They also act to disrupt the effectiveness of the spray from the water mist nozzles operating around the fire area. The acceptance criteria require no ignition or charring of the target cartons and consumption of not more than 50% of the cartons filled with plastic cups, when the fire ignition point is either directly under one nozzle, centered between two nozzles or centered between four nozzles.

This is an extremely severe series of fire tests in which the diffusers of the 9.2K-factor (metric)/0.64K-factor (NFPA) nozzles of this invention were found to perform extremely well when tested with a maximum spacing between nozzles of 2.5 m (8.2 ft.) and operating at a minimum pressure of 7 bar (102 psi). Under these conditions, there was no fire jump to the target cartons in any of the three fire tests. In the "under one nozzle" fire test, there was only about 1% loss of the fire source commodity, about 22% loss of the fire source commodity in the "centered between two nozzles" fire test and about 20% loss of the fire source commodity in the "centered between four nozzles" fire test.

There are presently no established standards or guidelines for evaluating water mist nozzles on the basis of minimum amount of water which must be collected per unit time over specified areas (i.e., density), e.g. under one nozzle, between two nozzles, and between four nozzles, when the nozzles are discharging under specified flowing (residual pressure) conditions. Each individual nozzle designer must establish the minimum required nozzle flow in combination with minimum required operating pressure and desired configuration of nozzle spray pattern required to achieve extinguishment (i.e. complete suppression of a fire until there are no burning combustibles); suppression (i.e. a sharp reduction in the rate of heat release of a fire with no re-growth); or control (i.e. limiting the growth of a fire by pre-wetting adjacent combustibles and controlling gas temperatures at the ceiling to prevent structural damage) by selected test fire scenarios, as necessary or as desired, over the area to be protected by the water mist nozzle.

The mechanisms by which water mist spray acts to extinguish, suppress, or control a fire can be a complex combination of the following factors, depending on the nature of the hazard being protected:

(1) Heat extraction from the fire as water is converted into vapor and the fuel is cooled;

(2) Reduced oxygen levels as the water vapor displaces oxygen near the fire;

(3) Direct impingement wetting and cooling of the combustibles;

(4) Enveloping of the protected area to cool gases and adjacent combustibles, as well as to pre-wet the adjacent combustibles while blocking them from the transfer of radiant heat; and (5) Dilution of flammable vapors by the entrainment of water, to such an extent that the resultant mixture of vapor will not burn.

In the "Fire Test Procedures for Equivalent Sprinkler Systems in Accommodation, Public Spaces and Service Areas on Passenger Ships" described in IMO Resolution A.800(19), factors (1) and (2) are primarily involved in the case of accommodation, service, and Class A combustible storage compartments, as well as in narrow corridors. In the case of public spaces, wide corridors, and other well ventilated large deck area spaces, factors (3) and (4) are primarily involved. In the case of Class B flammable liquid, shopping and storage areas, factors (1), (2), and (5) are normally involved.

The amount of evaporation, and hence the amount of heat extracted from the fire (i.e., cooling of the combustibles), is a function of the surface area of the water droplets applied for a given volume. Reducing droplet size increases total surface area, which in turn increases the cooling effect of a given volumetric flow rate of water. However, just having smaller droplet sizes does not necessarily mean better performance because the droplets must have the necessary momentum to be driven to the seat of the fire where they can provide rapid cooling and expansion to deny the fire of oxygen.

When water converts to vapor, it expands by about 1650 times, displacing and diluting oxygen in the fire area, thereby blocking the access of oxygen to the fuel. Arsonist fires in compartments, with their relatively rapid rate of heat release, are the easiest for water mist systems to extinguish due to the rapid vaporization which can occur with the relatively high level of heat present at nozzle operation.

In addition to the pre-wetting and cooling of the flames by vaporizing water droplets, fire extinguishment can be further enhanced by direct contact of the water droplets with the burning fuel to prevent further generation of the combustible vapors. This mode of fire extinguishment, which is normally associated with traditional sprinklers, tends to become more important as the degree of ventilation of the fire is increased.

Small droplets tend to remain suspended with the slightest of air currents. This temporary suspension results in a mist that is distributed throughout a protected space, to areas outside of the direct spray range of an individual nozzle. Under the influence of draft effects, water droplets are more likely to be drawn into the seat of the fire, where they can be rapidly vaporized. This three dimensional effect of the mist circulating around the space also helps to cool gases and other fuels in the area, blocking the transfer of radiant heat to adjacent combustibles, as well as pre-wetting them.

The flow rate "Q" from a water mist nozzle of the invention, in which a single stream of water is discharged from the outlet orifice, expressed in U.S. gallons per minute (gpm), is determined by the formula:

$$Q=K(p)^{1/2}$$

where: "K" represents the nominal nozzle discharge coefficient (normally referred to as K-factor) in NFPA units, and "p" represents the residual (flowing) pressure at the inlet to the nozzle in pounds per square inch (psi).

In the case of a diffuser impingement nozzle operating by impacting a relatively coherent, single water jet against a diffuser, the normal range of K-factors (hereafter understood to be in NFPA units) is in the range of about 0.10 to about 1.00, preferably in the range from about 0.15 to 0.70, and more preferably in the range of about 0.50 to about 0.70, the latter range being found more preferable from the standpoint of minimizing fire protection system installation costs and running power requirements (for a continuous flow system) by maximizing protection area per nozzle as well as minimizing nozzle flow rate and residual (flowing) pressure. Generally speaking, relatively low pressure diffuser impingement water mist nozzles are normally limited to a minimum K-factor of about 0.10 since, at lower K-factors, droplets will have insufficient momentum to drive to the seat of a fire, except in relatively small or minimal draft enclosures.

Also, in the general case, low pressure diffuser impingement water mist nozzles are normally limited to a maximum K-factor of about 1.0, since at higher K-factors, many of the droplets become too large to effectively vaporize and extract heat from a fire by cooling as well as reducing oxygen levels near the seat of a fire.

In addition, with larger K-factors, less mist is developed to envelop the protected area and block transfer of radiant heat to adjacent combustibles.

The overall shape of the water spray pattern directly affects circulation of air in the vicinity of a discharging nozzle. By shaping the diffuser of a pendent-type water mist nozzle, which operates by impacting a single, relatively coherent fluid jet against the diffuser, so that the spray is directed primarily radially outward in an overall umbrella-shaped pattern (i.e., initially generally parallel to the ceiling under which the nozzle is located), the thrust of the water spray is directed so that air along the ceiling is entrained by the water flow and swept outward and away from the nozzle. At the edges of the spray pattern, the air descends and circulates inward along the floor towards the center of the spray pattern, where it billows up, similar to a rising cumulus cloud.

Alternatively, by configuring the diffuser so that water is directed primarily downward in a more overall conical-shaped pattern, the thrust of the water spray is such that air is entrained by the downwardly directed water and draws air in along the ceiling towards the nozzle to establish a different overall circulation pattern. Depending on the intended fire protection application of a nozzle, either overall spray and circulation pattern, or even a superimposed combination of an outer umbrella-shaped and an inner conical-shaped pattern, may be desired, and those aspects of the overall spray pattern of the nozzle can be structured accordingly.

It has also been found that, within the overall spray pattern, it may be highly desirable to select particular zones in which there is some combination of a greater quantity of water discharged per unit area, larger droplets, and/or higher momentum droplets, as compared to the characteristics of the droplets in the surrounding spray pattern, to achieve prescribed purposes. Such prescribed purposes may include providing localized areas of higher thrust water droplets for penetration to the base of the fire, thereby tending to break it up, as well as drawing smaller droplets from the surrounding area to the fire zone, where they function to extract heat from the fire and reduce oxygen levels near the fire, as previously described.

According to the present invention, it has been found that a spray pattern structured with multiple relatively narrow zones of higher momentum, larger water droplets in the radially more remote regions of the spray pattern, i.e. than can be achieved with heretofore known deflector design techniques, is desirable for an automatic, pendent-type, diffuser impingement, water mist nozzle intended for fire protection service in marine applications involving shopping, storage, laundry and similar fire hazard category spaces as previously described. This arrangement provides the benefit of being able to better penetrate rapidly developing fires in concealed or shielded areas such as between racks or stacks of cartons in shopping and storage areas, in the outer portions of the area to be protected by the nozzle. Furthermore, for such a nozzle, it has been found that it is beneficial for the portion of the spray forming the overall umbrella-shaped pattern to be substantially continuous in elevation around its upper peripheral region, and as close to the ceiling as practical, without causing cold soldering of adjacent nozzles. This arrangement provides the benefits of minimizing growth of fires along walls by maintaining high wall wetting and of helping to prevent combustion gases from escaping from the fire area along the ceiling which, in turn, tends to reduce the amount of fresh air drawn along the floor into the fire area.

Heretofore, e.g. as described in Pounder U.S. patent application Ser. No. 08/718,914, filed Sep. 25, 1996, and in Fischer U.S. patent application Ser. No. 08/742,599, filed Oct. 28, 19965, the disclosures of which are incorporated herein by reference, it has been known that the parameters which establish spray patterns and, hence, circulation patterns of a pendent-type diffuser impingement nozzle operating by impacting a single, relatively coherent water jet against a substantially horizontal diffuser include:

the form or shape of the diffuser;

the outside dimensions of the diffuser;

the shape and arrangements of openings and tines located around the periphery of the diffuser; and the shape, size, and arrangement of holes located within the central area of the diffuser, in particular when such holes are utilized in conjunction with holes and/or tines located around the periphery of the diffuser.

The tines of a pendent diffuser tend to deflect water outwardly to fill in the area generally away from the nozzle. The angle, size and shape of the tines affect the pattern and quantity of outwardly deflected water. Water passing diagonally downward through spaces or openings between the tines forms the generally inner portion of the spray pattern, as well as the pattern beneath the nozzle, with the angle, size and shape of the openings between the tines affecting the pattern of the spray and the quantity, or density, of the water.

The outside dimensions of the diffuser affect the area of the spray pattern and, therefore, the area to be protected by the nozzle. Generally speaking, increasing the outer dimensions of the diffuser causes water to be distributed further away from the nozzle, with an associated reduction in the amount of water distributed around the inner portion of the spray pattern. The size, arrangement and shape of the holes defined in the interior area of the deflector affect the amount of water discharged in the area generally beneath the nozzle, which is in addition to that passing through the inner portion of the openings between the tines.

An objective of this invention is to provide a pendent-type diffuser impingement nozzle that enables readily controllable increases in the amount and momentum of water droplets distributed within desired outer portions of spray pattern a specified manner, without altering the radial area of the openings between the tines located around the periphery of the deflector and, therefore, undesirably forcing excess water to other portions of the spray pattern.

This objective is accomplished through the heretofore unknown use of channels located at predetermined positions on the diffuser, each channel collecting a portion of the water discharged from the outlet and diverted over the diffuser, the portion collected by each channel being diverted towards the desired outer portions of the spray pattern, with the number, dimensions and orientation of the channels being selected to achieve specifically desired characteristics for the water distribution pattern of the nozzle.

A further objective of this invention is to achieve the above objective with a spray pattern that is relatively stable over the pressure range of from less than 100 psi to more than 250 psi.

These and other features and advantages of the invention will be apparent from the following description of a presently preferred embodiment, and from the claims.

BRIEF DESCRIPTION OF THE DRAWINGS

FIG. 1 is a side elevational view of a pendent-type diffuser impingement water mist fire protection nozzle of the invention;

FIG. 2 is a side section view of the water mist fire protection nozzle taken at the line 2—2 of FIG. 1;

FIG. 3 is a top section view of the water mist fire protection nozzle taken at the line 3—3 of FIG. 1;

FIG. 4 is an enlarged side section view of the orifice insert of the water mist fire protection nozzle of FIG. 2;

DESCRIPTION OF THE PREFERRED EMBODIMENTS

Figure 5:
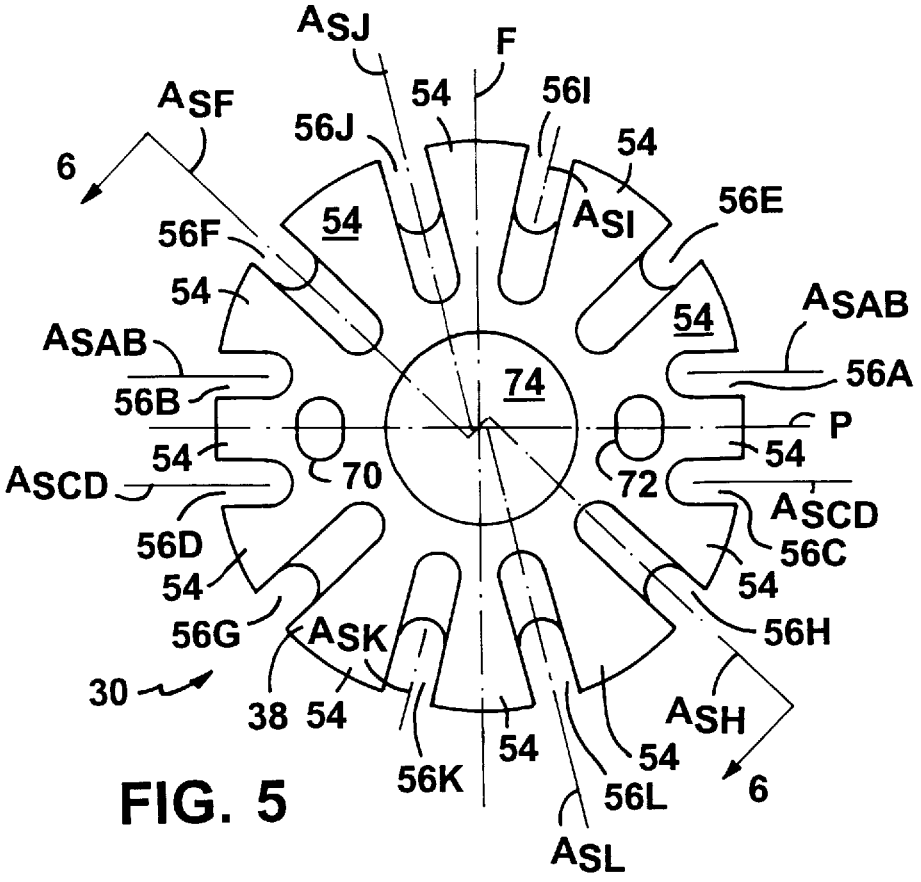
FIG. 5 is a top plan view of the diffuser element of the water mist fire protection nozzle of FIG. 1.

Referring to FIGS. 1–3, a pendent-type, diffuser impingement water mist nozzle 10 of the invention has a body 12 with a base 14 defining an inlet 16 for connection to a source of water under pressure (not shown), an outlet 18 with an axis, A, and an orifice 20, which is just upstream of, and coaxial with, the outlet. A strainer 17 is located at the inlet 16 to prevent debris larger than a preselected combination of dimensions from clogging water flow through orifice 20. U-shaped frame arms 22, 24 are attached to opposite sides of the base 14 and join at an apex 26 positioned downstream of, and coaxial with, the outlet 18. A substantially horizontal water distribution diffuser 30 is affixed to, and disposed coaxial with, the apex 26. Referring to FIG. 3, in the preferred embodiment, the diffuser 30 has an elliptical shape and it is mounted to the apex 26 with its major diameter, $D_M$ (FIGS. 7 and 8), aligned generally in a plane, F, of the frame arms 22, 24 and a minor diameter, $D_m$ (FIGS. 7 and 8), in a plane, P, generally perpendicular thereto.

The outlet 18 of the diffuser impingement nozzle 10 of the invention is normally closed by a plug 32, which is held in place by a thermally responsive element 34, e.g. frangible glass bulb, configured to burst apart and automatically release the plug 32 when the thermally responsive element is heated to within a specified operating temperature range for a preselected nominal temperature rating, e.g. as 68° C. (155° F.). An ejection spring 33 ensures that the plug 32 is thrown free from the nozzle 10 upon bursting of the thermally responsive element 34. In the preferred embodiment, the thermally responsive element 34 is a nominally 3 mm (0.12 inch) diameter frangible glass bulb, available, e.g. in temperature ratings of 57° C. (135° F.), 68° C. (155° F.), 79° C. (175° F.) and 93° C. (200° F.). Upon release of the plug 32, a vertically directed, relatively coherent, single stream of water passing through an orifice insert 36 (FIGS. 2 and 4) rushes downward from the outlet 18 towards the diffuser 30. The water stream from the outlet 18 impacting upon the opposed, inner surface 38 of the diffuser 30 is diverted generally radially downward and outward by the diffuser, breaking up into a spray pattern which is primarily a function of the diffuser design.

Figure 6:
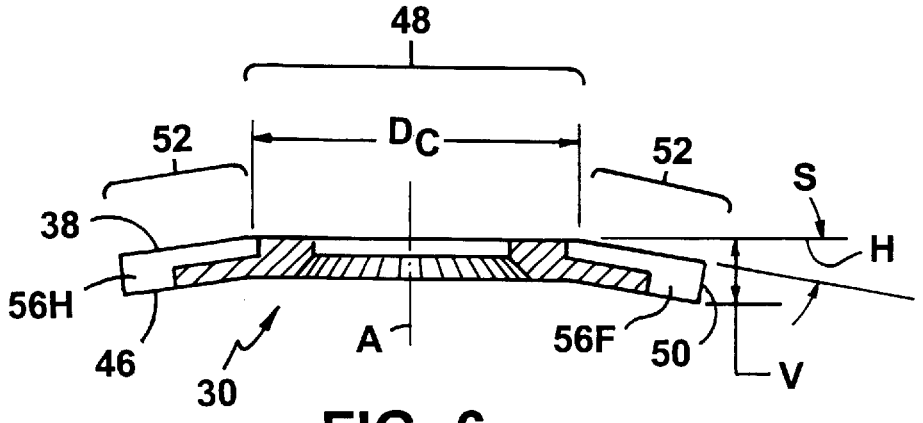
FIG. 6 is a side section view of the diffuser element of the water mist fire protection nozzle taken at the line 6—6 of FIG. 5.

Referring also to FIGS. 5–6 and to FIGS. 7–10, in the preferred embodiment, the diffuser 30 of the diffuser impingement, water mist nozzle 10 of the invention has an elliptical shape, with a major outside diameter, $D_M$, and a minor outside diameter, $D_m$, in the blank state (FIGS. 8–10), e.g. about 0.755 inch and 0.675 inch, respectively. (The blank form of the diffuser is labeled as 31 in FIGS. 7–10 to distinguish it from the final, formed state of diffuser 30 in FIGS. 1–3 and 5–6.) The diffuser 30, which has a thickness, t, e.g. about 0.051 inch, is fabricated from a phosphor bronze alloy UNSC52100, Temper H02 (half hard), per ASTM B103.

Referring to FIGS. 5 and 6, in the formed state, the diffuser 30 has an inside or receiving surface 38 downstream of, and facing towards, i.e. opposing, the nozzle outlet 18 and an outside surface 46 on the opposite side of the diffuser, i.e. facing away from the nozzle outlet. The inside surface 38 of the diffuser 30 defines a substantially flat, central base area 48 having an outer diameter, $D_C$, e.g. of about 0.440 inch. The inside surface 38 of the diffuser 30 further defines a generally annular outer region 52 having the general shape of a truncated cone slanted at a downward angle, S, e.g. about 10° relative to a plane, H, of the horizontal base area 48. The vertical dimension, V, of the diffuser 30 in formed state, measured in the region of the peripheral edge 50, is about 0.078 inch.

Distributed about the periphery of the diffuser 30 are a plurality of tines 54 (e.g., in the preferred embodiment, twelve tines are shown) defining a plurality of slots 56A–56L between adjacent tines (again, in the preferred embodiment, the twelve tines define twelve slots, each slot having a width, $W_S$, e.g. about 0.062 inch).

In the preferred embodiment, the slots are divided into three sets having different characteristics.

In particular, slots 56A, 56B and slots 56C, 56D are disposed along common axes, $A_{SAB}$, $A_{SCD}$, spaced from (by a distance, $S_S$ (FIG 7), e.g. about 0.071 inch) and generally parallel to the plane, P, lying generally perpendicular to the plane, F, of the frame arms. The slots 56A, 56B, 56C, 56D have a depth, $D_{S\ 1}$, measured from the peripheral edge, along the axes, $A_{SAB}$, $A_{SCD}$, e.g. about 0.0965 inch.

Slots 56E, 56F, 56G, 56H are disposed along axes $A_{SE}$, $A_{SF}$, $A_{SG}$, $A_{SH}$, respectively, each lying at an angle, Q, e.g. about 45°, to the plane, P, generally perpendicular to the plane, F, of the frame arms. The axes $A_{SE}$, $A_{SF}$, $A_{SG}$, $A_{SH}$ are non-radial with respect to the axis, A, of the diffuser, with each of axes $A_{SE}$, $A_{SF}$, $A_{SG}$, $A_{SH}$ intersecting the plane, P, at a point spaced by a distance, $O_1$, e.g. about 0.028 inch, along the plane, P, to the side of the plane, F, nearest the respective slot. Each of the slots 56E, 56F, 56G, 56H has a depth, $D_{S2}$, measured from the peripheral edge, along the axes, $A_{SE}$, $A_{SF}$, $A_{SG}$, $A_{SH}$, e.g. about 0.072 inch.

Slots 56I, 56J, 56K, 56L are disposed along axes $A_{SI}$, $A_{SJ}$, $A_{SK}$, $A_{SL}$, respectively, each lying at an angle, X, e.g. about 13.6°, to the plane, F, of the frame arms. The axes $A_{SI}$, $A_{SJ}$, $A_{SK}$, $A_{SL}$ are non-radial with respect to the axis, A, of the diffuser, with each of axes $A_{SI}$, $A_{SJ}$, $A_{SK}$, $A_{SL}$ intersecting the plane, P, at a point spaced by a distance, $O_2$, e.g. about 0.010 inch, along the plane, P, to the side of the plane, F, nearest the respective slot. Each of the slots 56I, 56J, 56K, 56L has a depth, $D_{S3}$, measured from the peripheral edge, along the axes, $A_{SI}$, $A_{SJ}$, $A_{SK}$, $A_{SL}$, e.g. about 0.110 inch.

The inner surface 38 of the diffuser 30 further defines channels 58E, 58F, 58G, 58H extending along the axes, $A_{SE}$, $A_{SF}$, $A_{SG}$, $A_{SH}$, respectively, to include slots 56E, 56F, 56G, 56H, respectively; and also defines channels 58I, 58J, 58K, 58L extending along the axes, $A_{SI}$, $A_{SJ}$, $A_{SK}$, $A_{SL}$, respectively, to include slots 56I, 56J, 56K, 56L, respectively.

Figure 10:
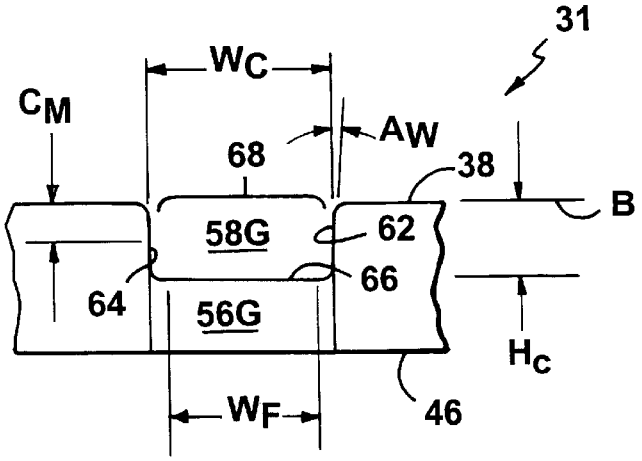
FIG. 10 is a side view of the blank for forming the diffuser element of the water mist fire protection nozzle taken at the line 10—10 of FIG. 7.
Figure 9:
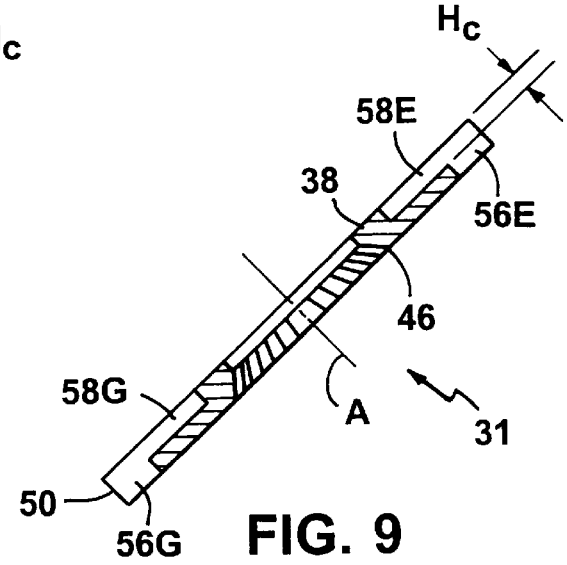
FIG. 9 is a side section view of the blank for forming the diffuser element of the water mist fire protection nozzle taken at the line 9—9 of FIG. 7.

Referring also to FIG. 10, channel 58G terminating at slot 56G is shown, by way of example. In the preferred embodiment, the configuration of the channel 58G is representative of other channels 58E, 58F, 58H, 58I, 58J, 58K, 58L. The channel 58G is defined by sidewalls 62, 64 and bed wall 66. The sidewalls have a height, $H_C$, resulting in channels of corresponding depth, e.g., in the range of about 0.015 inch to 0.050 inch, preferably in the range of about 0.020 inch to 0.040 inch, and more preferably about 0.025 inch. The base wall 66 defines a relatively flat center region 68 having a width, $W_F$, e.g. of at least about 0.051 inch. The channel has an overall effective width, $W_C$, e.g. in the range of about 0.030 inch to 0.090 inch, preferably in the range of about 0.045 inch to 0.075 inch, and more preferably about 0.062 inch, measured at a depth, $C_M$, e.g. about 0.013 inch below the plane, B, of the inner surface 36, the walls 62, 64 of the channel 58G above the point of measurement sloping outwardly from the channel bed at an angle, $A_W$, e.g. a maximum of about 5°, measured from the vertical. Each of the channels 58E, 58F, 58G, 58H, 58I, 58J, 58K, 58L extends inwardly, generally towards the axis, A, to terminate at a circular arc, T, centered on the axis, A, and having a diameter, $T_S$, e.g. about 0.340 inch.

In the preferred embodiment, the axes $A_{SE}$, $A_{SF}$, $A_{SG}$, $A_{SH}$, $A_{SI}$, $A_{SJ}$, $A_{SK}$, $A_{SL}$ of the channels/slots 56E/58E, 56F/58F, 56G/58G, 56H/58H, 56I/58I, 56J/58J, 56K/58K, 56L/58L are non-radial relative to the arc circle, T.

Figure 7:
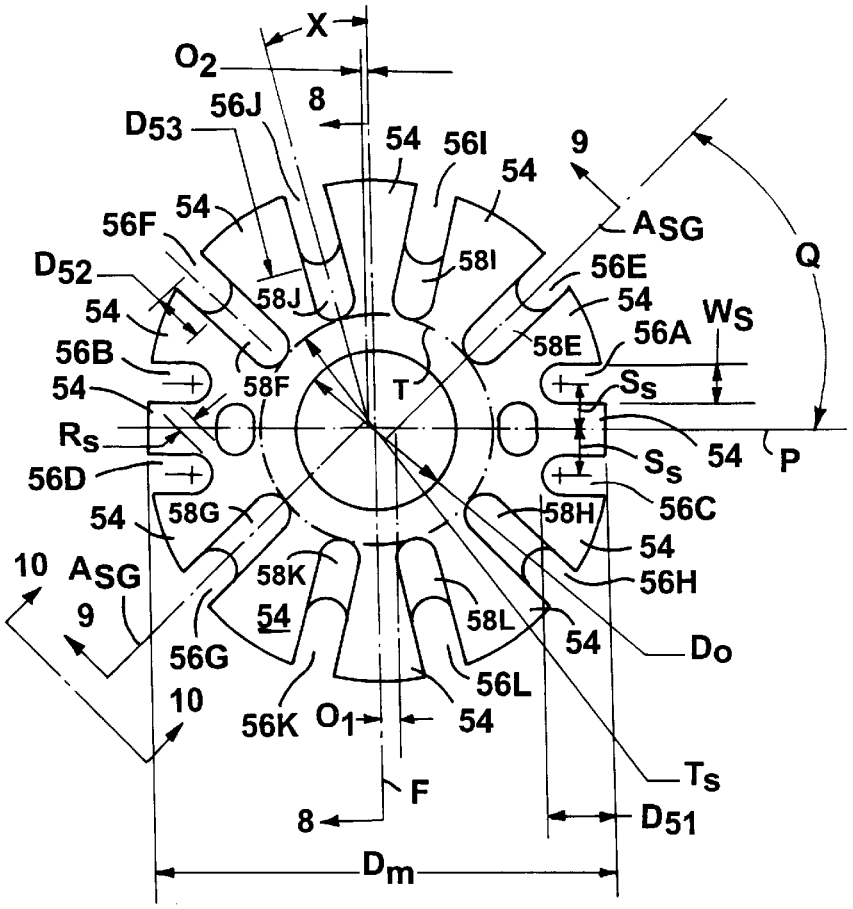
FIG. 7 is a top plan view of a blank for forming the diffuser element of the water mist fire protection nozzle of FIG. 1.
Figure 8:
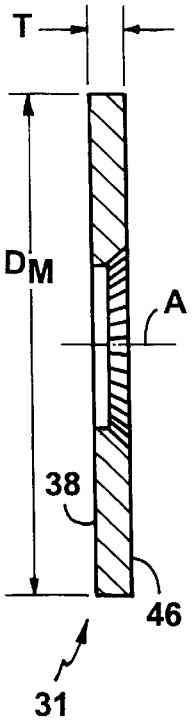
FIG. 8 is a side section view of the blank for forming the diffuser element of the water mist fire protection nozzle taken at the line 8—8 of FIG. 7.
Figure 11:
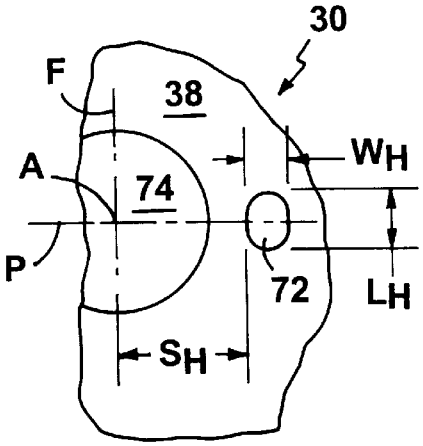
FIG. 11 is a plan view of a segment of the inner surface of the blank for forming a diffuser element of the water mist fire protection nozzle.

Referring also to FIGS. 5 and 11, the diffuser 30 defines a pair of elliptical through holes 70, 72 disposed along the plane, P, at either side of a center (mounting) orifice 74. The holes 70, 72 have a width, $W_H$, e.g. about 0.062 inch, and a length, $L_H$, e.g. about 0.082 inch, and they are spaced at a distance, $S_H$, from the plane, F, extending through the diffuser axis, A, e.g. about 0.175 inch. Referring to FIG. 7, the holes 70, 72 are spaced from the adjacent slots by a minimum distance, $R_S$, e.g. about 0.031 inch. The center (mounting) hole 74 has a diameter, $D_O$, e.g. about 0.252 inch.

A commercial embodiment of the water mist nozzle 10 of the invention is represented by a Model AM24 AquaMist® Nozzle, as manufactured by Grinnell Corporation, 3 Tyco Park, Exeter, N.H. 03833 and described in Technical Data Sheet TD1170.

Other embodiments are within the following claims. For example, other numbers of channels, e.g. two or more, may be defined in the inner surface of the diffuser. The diffuser may be without or define any number of through holes. One or more of the channels may terminate other than at slots defined between tines. The diffuser may have a peripheral shape other than elliptical. One or more channels may extend radially outward from the diffuser axis, A. One or more channels may be defined in regions of a diffuser surface that are flat or other profile. Any two or more of he channels may be interconnected. The bed wall of any one or more of the channels may define the through hole to the outside surface of the diffuser.

All of the above are applied without departing from the spirit and scope of this invention. In addition, the term "impingement water mist fire protection nozzle" as used in the claims is intended to include fire protection sprinklers to which the principles described above can also be applied.

What is claimed is:

1. A pendent-type diffuser impingement water mist fire protection nozzle comprising:

a body defining an orifice and an outlet for flow of water from a source, said orifice defining an axis, and said outlet being disposed generally coaxial with said orifice, and a diffuser disposed generally coaxial with said axis of said orifice and defining a diffuser inner surface positioned for impingement of the flow of water thereupon and an opposite outer surface, said diffuser comprising a plurality of tines distributed about a diffuser periphery and defining a plurality of openings therebetween, and said diffuser inner surface defining at least one channel extending along said inner surface toward a predetermined region of said diffuser periphery, said channel being positioned to collect at least a portion of the water impinging thereupon and to divert collected water toward said predetermined region of said diffuser periphery.

2. The pendent-type diffuser impingement water mist fire protection nozzle of claim 1 wherein said diffuser inner surface defines at least two said channels.

3. The pendent-type diffuser impingement water mist fire protection nozzle of claim 2 wherein said diffuser inner surface defines at least four said channels.

4. The pendent-type diffuser impingement water mist fire protection nozzle of claim 3 wherein said diffuser inner surface defines at least eight said channels.

5. The pendent-type diffuser impingement water mist fire protection nozzle of claim 1 wherein said diffuser inner surface defines one or more through holes spaced from said diffuser periphery.

6. The pendent-type diffuser impingement water mist fire protection nozzle of claim 1 wherein said at least one channel terminates at one end at a said opening between said tines.

7. The pendent-type diffuser impingement water mist fire protection nozzle of claim 1 wherein said diffuser has an elliptical shape.

8. The pendent-type diffuser impingement water mist fire protection nozzle of claim 1 wherein said at least one channel extends non-radially along said diffuser inner surface.

9. The pendent-type diffuser impingement water mist fire protection nozzle of claim 1 wherein said at least one channel extends radially along said diffuser inner surface.

10. The pendent-type diffuser impingement water mist fire protection nozzle of claim 1 wherein said diffuser inner surface slopes away from said outlet outwardly from said axis.

11. The pendent-type diffuser impingement water mist fire protection nozzle of claim 1 wherein said at least one channel has a depth in the range of about 0.015 inch to about 0.050 inch.

12. The pendent-type diffuser impingement water mist fire protection nozzle of claim 11 wherein said depth of said at least one channel is in the range of about 0.020 inch to about 0.040 inch.

13. The pendent-type diffuser impingement water mist fire protection nozzle of claim 12 wherein said depth of said at least one channel is about 0.025 inch.

14. The pendent-type diffuser impingement water mist fire protection nozzle of claim 1 wherein said at least one channel has a width in the range of about 0.030 inch to about 0.090 inch.

15. The pendent-type diffuser impingement water mist fire protection nozzle of claim 14 wherein said width of said at least one channel is in the range of about 0.045 inch to about 0.075 inch.

16. The pendent-type diffuser impingement water mist fire protection nozzle of claim 15 wherein said width of said at least one channel is about 0.062 inch.

17. The pendent-type diffuser impingement water mist fire protection nozzle of claim 1 wherein said nozzle has a K-factor in the range of about 0.10 to about 1.0.

18. The pendent-type diffuser impingement water mist fire protection nozzle of claim 17 wherein said nozzle has a K-factor in the range of about 0.15 to about 0.70.

19. The pendent-type diffuser impingement water mist fire protection nozzle of claim 18 wherein said nozzle has a K-factor in the range of about 0.50 to about 0.70.

* * * * *